US008938822B2

(12) United States Patent
Eleftheriou

(10) Patent No.: US 8,938,822 B2
(45) Date of Patent: Jan. 27, 2015

(54) METHOD AND APPARATUS FOR USE WITH A TOILET

(76) Inventor: George Yiergos Eleftheriou, Haverhill, MA (US)

( * ) Notice: Subject to any disclaimer, the term of this patent is extended or adjusted under 35 U.S.C. 154(b) by 753 days.

(21) Appl. No.: 13/102,507

(22) Filed: May 6, 2011

(65) Prior Publication Data

US 2012/0278984 A1 Nov. 8, 2012

(51) Int. Cl.
*E03D 1/00* (2006.01)
*E03D 9/06* (2006.01)
*E03D 9/00* (2006.01)

(52) U.S. Cl.
CPC . *E03D 9/06* (2013.01); *E03D 9/007* (2013.01)
USPC ..... 4/353

(58) Field of Classification Search
CPC ..... A47K 17/00; E03D 1/01
USPC ..... 4/353–442
See application file for complete search history.

(56) References Cited

U.S. PATENT DOCUMENTS 2,099,932 A * 11/1937 Isaacson ..... 4/353
2,434,399 A 1/1948 Duckenfield
2,701,702 A * 2/1955 Diederich ..... 248/302
4,174,589 A 11/1979 Daharsh
4,319,367 A * 3/1982 Cantillo ..... 4/353
4,434,938 A * 3/1984 Rosenkrantz et al. ..... 239/274
4,918,769 A * 4/1990 Gandini ..... 4/661
4,924,547 A * 5/1990 Wachtel et al. ..... 15/185
5,345,617 A * 9/1994 Jahner et al. ..... 4/217
5,396,666 A * 3/1995 Tsai et al. ..... 4/325
5,502,847 A * 4/1996 Weeks ..... 4/411
5,640,722 A * 6/1997 Bui ..... 4/353
5,862,536 A 1/1999 Huang
5,983,411 A * 11/1999 Demoret ..... 4/353
6,055,680 A * 5/2000 Tolbert ..... 4/255.11
6,883,189 B2 * 4/2005 Pierce ..... 4/661
7,073,209 B1 * 7/2006 McCormick ..... 4/227.1
2003/0226198 A1 * 12/2003 Harbutt et al. ..... 4/227.1
2005/0050630 A1 * 3/2005 Spreitzer ..... 4/661
2006/0123531 A1 * 6/2006 Karlicek ..... 4/255.11
2006/0156461 A1 * 7/2006 Pierce ..... 4/353
2007/0094779 A1 * 5/2007 Dauphin ..... 4/255.01
2009/0212674 A1 * 8/2009 Harris ..... 312/237
2010/0127607 A1 5/2010 Harris
2011/0162983 A1 * 7/2011 Weis et al. ..... 206/229
2011/0259973 A1 * 10/2011 Pedicano et al. ..... 239/44

* cited by examiner

*Primary Examiner* — Lori Baker
(74) *Attorney, Agent, or Firm* — Hayes Soloway PC

(57) ABSTRACT

The present disclosure is directed to an apparatus for use with a toilet and a method of storing and cleaning a toilet utensil. The apparatus includes a toilet having a toilet bowl, a tank storing a quantity of water, and a flushing device controlling a flow of the quantity of water from the tank to the toilet bowl. A toilet utensil holding structure is located within the tank, wherein the toilet utensil holding structure positioned to hold at least one toilet utensil. A tank cover is positioned over an opening in the tank. The tank cover has at least two cover portions independently movable to one another, wherein at least one of the two cover portions controls access to the at least one toilet utensil.

15 Claims, 7 Drawing Sheets

METHOD AND APPARATUS FOR USE WITH A TOILET

FIELD OF THE DISCLOSURE

The present disclosure is generally related to toilet apparatus and more particularly is related to a method and apparatus for use with a toilet.

BACKGROUND OF THE DISCLOSURE

Toilet plungers and other cleaning devices have long been used to unblock and clean toilet drains. It is preferable to store such devices out of sight, since they are generally unsightly and unsanitary, but such devices are often difficult to store because of the limited amount of space in most bathrooms. Attempts have been made to solve this problem, but they have many shortcomings. For example, some cleaning devices are stored within their own housing containers at the base of a toilet. While this may prevent the unsightly qualities of the cleaning device, it is largely unsuccessful at preventing the spread of bacteria or the spread of undesirable odors.

Furthermore, even though many toilet plungers and other cleaning devices are dirty and unsanitary after being used, they are rarely cleaned after being used. In addition to being highly undesirable, when these devices are left in their unsanitary state lying around a restroom, they are likely to spread bacteria and other harmful substances, which may cause sickness in users of the restroom. Although an adult may be happy to ignore and avoid the dirty cleaning devices, young children and animals may find their way to these cleaning devices and subject themselves to the unsanitary conditions.

Thus, a heretofore unaddressed need exists in the industry to address the aforementioned deficiencies and inadequacies.

SUMMARY OF THE DISCLOSURE

Embodiments of the present disclosure provide an apparatus for use with a toilet. Briefly described, in architecture, one embodiment of the apparatus, among others, can be implemented as follows. The toilet has a toilet bowl, a tank storing a quantity of water, and a flushing device controlling a flow of the quantity of water from the tank to the toilet bowl. The apparatus includes a toilet utensil holding structure located within the tank, wherein the toilet utensil holding structure positioned to hold at least one toilet utensil. A tank cover is positioned over an opening in the tank, wherein the tank cover having at least two cover portions independently movable to one another, and wherein at least one of the two cover portions controls access to the at least one toilet utensil.

The present disclosure can also be viewed as a toilet apparatus. Briefly described, in architecture, one embodiment of the apparatus, among others, can be implemented as follows. A toilet structure has a toilet bowl, a tank storing a quantity of water, and a flushing device controlling a flow of the quantity of water from the tank to the toilet bowl. A toilet utensil holding structure is located within the tank, wherein the toilet utensil holding structure positioned to hold at least one toilet utensil having a handle portion and a utensil portion substantially vertically within the tank, and wherein the utensil portion is fully submerged within the quantity of water. A tank cover is positioned over an opening in the tank, wherein the tank cover has at least two cover portions independently movable to one another, wherein at least one of the two cover portions controls access to the at least one toilet utensil. An air freshener mechanism is positioned proximate to the toilet and in communication with the flushing device, wherein activation of the flushing device activates the air freshener mechanism to release a quantity of air-freshening material into a surrounding atmosphere.

The present disclosure can also be viewed as providing a method for storing and cleaning toilet utensils. In this regard, one embodiment of such a method, among others, can be broadly summarized by the following steps: storing a quantity of water within an interior of a tank of a toilet; providing access to the interior of the tank with a cover, the cover having at least two cover portions independently movable to one another; positioning a toilet utensil holding structure within the tank; retaining at least one toilet utensil having a handle portion and a utensil portion within the tank with the toilet utensil retaining structure, wherein the at least one utensil is oriented substantially vertical and wherein the utensil portion submerged within the quantity of water; and flushing the quantity of water from within the tank to a toilet bowl with a flushing device.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
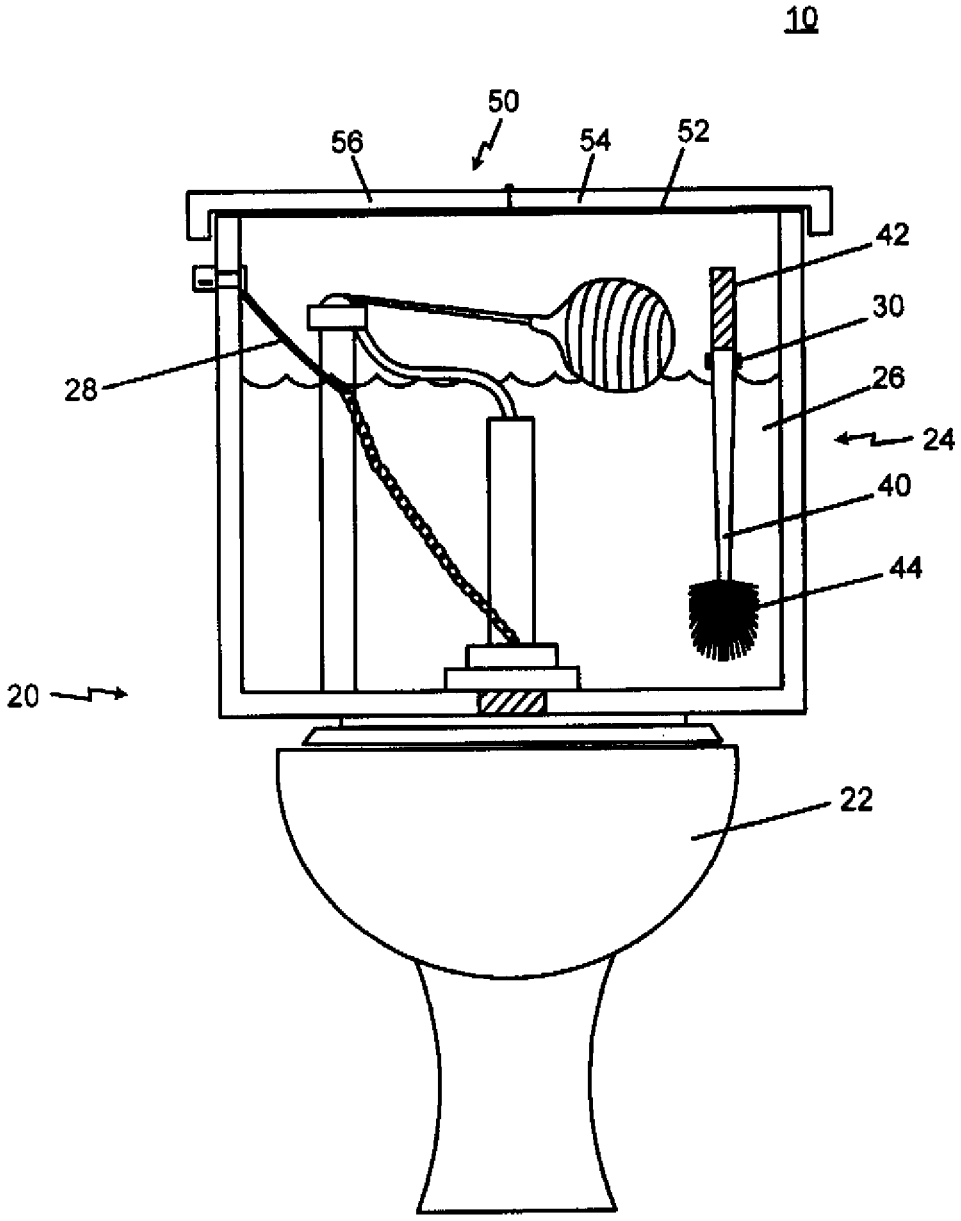
FIG. 1 is an illustration of a partial cross-sectional front view of an apparatus for use with a toilet, in accordance with a first exemplary embodiment of the present disclosure.

FIG. 1 is an illustration of a partial cross-sectional front view of an apparatus 10 for use with a toilet, in accordance with a first exemplary embodiment of the present disclosure. The apparatus 10 is for use with a toilet 20 or similar plumbing fixture. A toilet 20, at an elementary level, may include a toilet bowl 22, a tank 24 storing a quantity of water 26, and a flushing device 28 that controls the flow of the quantity of water 26 from the tank 24 to the toilet bowl 22. A toilet utensil holding structure 30 may be located within the tank 24. The toilet utensil holding structure 30 is positioned to hold at least one toilet utensil 40. A tank cover 50 is positioned over an opening 52 in the tank 24. The tank cover 50 has at least two cover portions 54, 56 that are independently movable to one another. At least one of the two cover portions 54, 56 controls access to the toilet utensil 40.

The apparatus 10 is preferably used with various types of toilets 20, but may also be used with other plumbing fixtures. For example, the apparatus 10 may be used with a flush toilet, which is a toilet 20 that disposes of waste by using water to flush the waste through a drainpipe to another location. The embodiments of this disclosure are discussed in connection with flush toilets, however the present disclosure including components of the disclosure may be used with plumbing fixtures other than flush toilets, all of which are considered within the scope of the present disclosure.

The general structure of a toilet 20 is generally well known within the industry. As is shown in FIG. 1, the toilet 20 has a toilet bowl 22 that is located proximate to the floor, usually supported by a toilet base. The toilet tank 24 is usually affixed or connected to the toilet bowl 22 in a higher relative position to the toilet bowl 22. Toilet tank 24 includes a water supply that partially fills the toilet tank 24 with a quantity of water 26, which is used to flush the waste from within the toilet bowl 22. Flushing is generally accomplished with a flushing device 28, which may come in many forms with many variations. Although it is desirable to use as little water as possible with the flushing operation, a certain amount of water is required to ensure that all waste is properly flushed from within the toilet bowl 22. For instance, many older toilets 20 operated on a 5-gallons per flush standard, which equates to an estimated 140 gallons of water used per day for a family of four. Newer toilets operate on substantially less than 5-gallons per flush. Commonly, a new toilet uses 1.6-gallons per flush, but there are additional mechanisms and devices that can be used to further decrease the amount of water used in a toilet. For example, some flushing devices 28 include a high-pressure or pressure-assist valve that may lower the amount of water used to between 1.4 gallons and 1.1 gallons per flush.

There are many variations on flushing devices 28 available. Some of these include the tank style with flapper-flush-valve, the tank style with siphon-flush-valve, the tank style with high-pressure or pressure-assist valve, and the tankless style with high-pressure valve, just to name a few. Likely the most popular type of flushing device 28 currently used includes a tank fill valve that is opened or shut with a float valve. The float valve usually includes a floatable portion, which sits near the top surface of the quantity of water 26. Accordingly, when the toilet 20 is flushed, a valve is opened to release at least a portion of the quantity of water 26 into the toilet bowl 22, thus decreasing the quantity of water 26 within the tank 24. When the quantity of water 26 decreases below a predetermined amount (or falls below a certain height within the tank 24), the float valve opens the tank fill valve to inject more water into the tank 24. When the quantity of water 26 within the tank 24 reaches a certain volume or a certain height in the tank 24, the float valve closes the tank fill valve. The present disclosure is described in detail with this tank fill valve and float valve flushing device 28. However, many types of flushing devices 28 and many types of toilets 20 may be used successfully with the apparatus 10, all of which are considered within the scope of the present disclosure.

Any toilet 20 that utilizes a tank 24 must have a tank 24 that is sized to appropriately house the quantity of water 26, so it can be properly released into the toilet bowl 22 when the toilet 20 is flushed. Accordingly, tanks 24 include enough interior space to house the quantity of water 26 and the flushing device 28 (or at least a portion thereof) with room to spare. The apparatus 10 may utilize this spare room within the tank 24 to store and clean toilet utensils 40. In accordance with this disclosure, toilet utensils 40 may include any type of toilet accessory, most commonly a toilet cleaning brush (as shown in FIG. 1) and a toilet plunger. Other toilet accessories not explicitly named here may also be considered toilet utensils 40. Commonly, the toilet utensil 40 includes a handle portion 42 and a utensil portion 44, wherein the user grasps the handle portion 42 to direct the utensil portion 44 to touch the toilet 20. For example, both a toilet brush and a toilet plunger have handle portions 42 connected to utensil portions, i.e., the brush bristles or the rubber cap of the plunger.

The toilet utensil holding structure 30 may be located within the spare room inside the tank 24, as shown in FIG. 1. Commonly, the toilet utensil holding structure 30 may be placed off to one side of the toilet tank 24, however any location within the tank 24 is acceptable. The toilet utensil holding structure 30 may include a variety of designs and configurations to hold at least one toilet utensil 40. The design of the toilet utensil holding structure 30 may depend on the number of toilet utensils 40 that are being held, the type of toilet 20, the size or configuration of the tank 24, and/or the configuration of the restroom that the toilet 20 is housed in. The toilet utensil holding structure 30 may be capable of holding any number of toilet utensils 40.

The toilet utensil holding structure 30 may be positioned or affixed within the tank 24 in a number of ways. This includes incorporating the toilet utensil holding structure 30 within newly manufactured toilets, such as by designing a plastic, metal, ceramic, or porcelain toilet utensil holding structure 30 within the tank 24. The toilet utensil holding structure 30 may also be retrofitted to any newly manufactured or already existing toilet 20. For example, the toilet utensil holding structure 30 may include a substantially linear bar that traverses between two or more sidewalls of the tank 24 and is retained in place with a fastener, connector, friction-fit device, adhesive or other retention mechanism. For example, the toilet utensil holding structure 30 may include an extendable linear structure that biases outward (in opposing directions) against two parallel sidewalls of the tank 24, and is configured to hold a toilet utensil 40. This type of toilet utensil holding structure 30 may be easily installed and removed from a tank 24. The toilet utensil holding structure 30 may also include a unitary structure that is positioned on or affixed to only one sidewall of the tank 24 and holds a toilet utensil 40. Other toilet utensil holding structures 30 may be supported from the base of the tank 24, the cover 50, or by hanging over a sidewall of the tank 24. Of course, other designs not explicitly discussed herein, or variations on designs discussed herein may also be included with the toilet utensil holding structure 30.

The toilet utensil holding structure 30 may hold one or more toilet utensils 40 in a number of ways, such as with a fitted plastic, metal, or rubber clip. For example, a "C" shaped clip may be sized to receive part of the toilet utensil 40, such that it can be easily placed and removed on the toilet utensil holding structure 30. Other ways of holding the toilet utensil 40 may include adhesives, biasing members, hook and loop fasteners, male and female connectors, and any other type of retention device. The toilet utensil holding structure 30 may hold the toilet utensil 40 in various positions within the tank 24, including in a position away from the sidewall of the tank 24, thereby allowing room for the toilet utensil 40, such as to prevent the brush head or plunger head on a brush or plunger from touching the sidewall. Also, it may be preferable for the toilet utensil holding structure 30 to retain the toilet utensil 40 in a substantially vertical position, thus keeping part of the toilet utensil 40 from being submerged in the water, and making it easier for a user to grasp the toilet utensil 40. However, it is noted that the toilet utensil holding structure 30 may retain the toilet utensil 40 in angled positions without limitation.

The tank cover 50 is positioned over the opening 52 in the tank 24. The tank cover 50 almost always forms the top surface of the toilet tank 24, such that when the toilet cover 50 is in place on the tank 24, the interior contents of the tank 24 are concealed from view. As discussed previously, toilet utensils 40 may be stored within the tank 24, thus the tank cover 50 must permit access to the interior of the tank 24. Conventional tank covers 50 are commonly a unitary structure constructed from porcelain or another heavy material. Although removing these conventional tank covers 50 occasionally for repairs to the toilet may not be a problem, it is inconvenient, inefficient, and impractical to remove these unitary tank covers 50 for retrieving toilet utensils 40. Therefore, the tank cover 50 includes at least two cover portions 54, 56 that are independently movable to one another. This allows for one of the cover portions 56 to remain in place over the opening 52 of the tank 24, while the other cover portion 54 is moved to reveal the interior of the tank 24, and control access to the toilet utensil 40 housed inside the tank 24.

Figure 2:
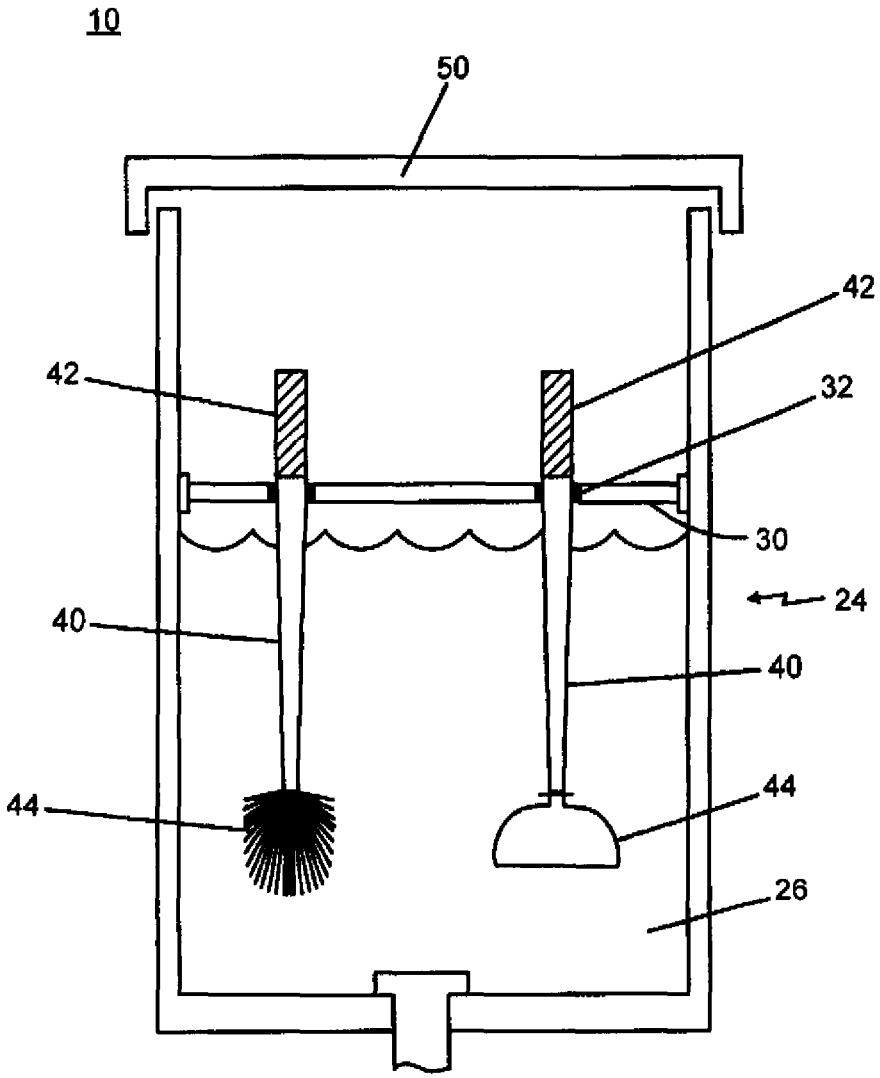
FIG. 2 is an illustration of a cross-sectional side view of the apparatus for use with a toilet, in accordance with the first exemplary embodiment of the present disclosure.

FIG. 2 is an illustration of a cross-sectional side view of the apparatus 10 for use with a toilet, in accordance with the first exemplary embodiment of the present disclosure. As shown, toilet utensil holding structure 30 may be capable of holding more than one toilet utensil 40. Here, the toilet utensil holding structure 30 includes a design with a rigid member traversing between two sidewalls of the tank 24. The rigid member may include a high-friction material, such as rubber, on each end, which contacts the sidewall of the tank 24 to retain the toilet utensil holding structure 30 in a substantially stationary place. It is noted that the toilet utensil holding structure 30 may be positioned in the tank 24 in a location above or below the water line, depending on design. The toilet utensil holding structure 30 includes a utensil-retaining member 32 for each of the toilet utensils 40 that the toilet utensil holding structure 30 is supporting. The utensil-retaining member 32 may include friction clips, biasing clips, adhesive devices, or any other device that can retain the toilet utensil 40. As with any devices that are designed to contact water or be in close proximity to water, any of the structures or components within the apparatus 10 may be constructed from water-resistant materials, which includes corrosion-resistant and rot-resistant materials. For example, the apparatus 10 or components thereof, may be constructed from rust-resistant metals, plastics, synthetic materials, or natural materials that can be stored in water environments.

Figure 3:
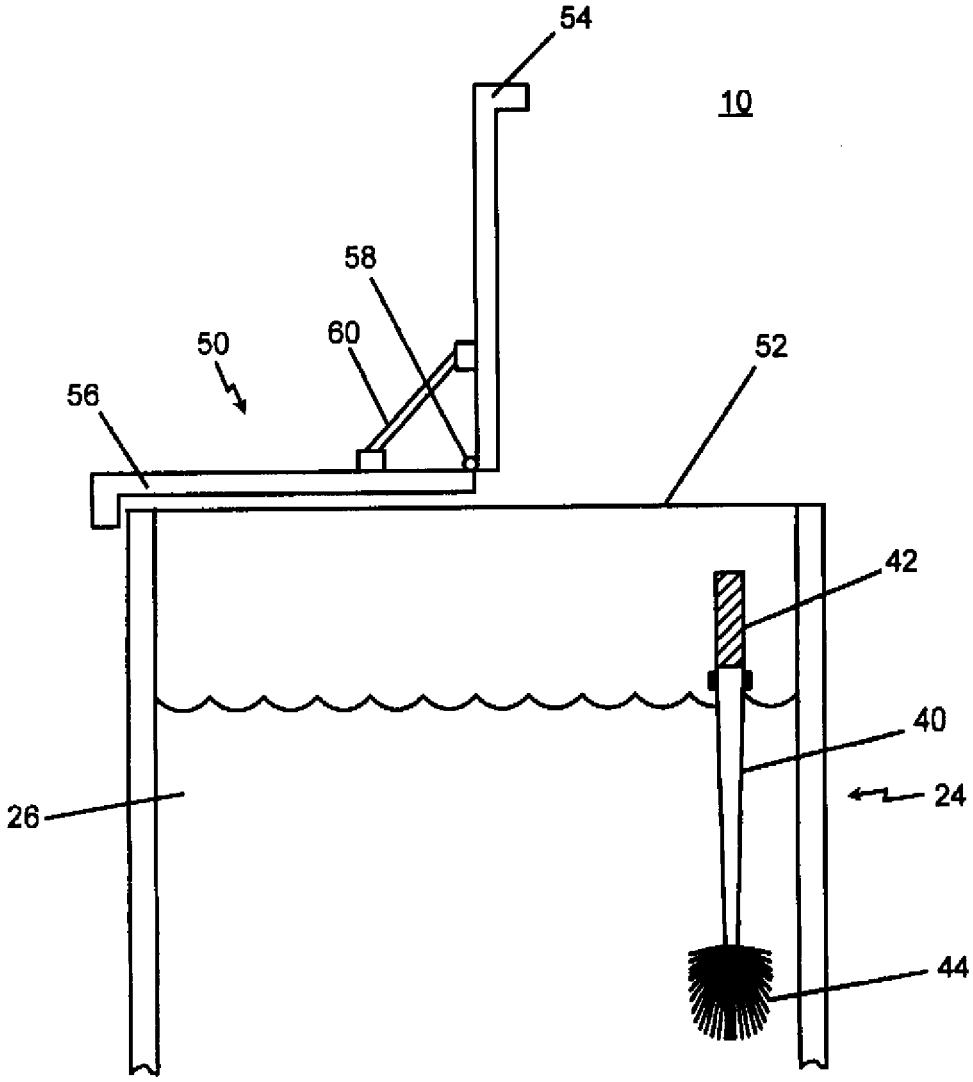
FIG. 3 is an illustration of a cross-sectional front view of the apparatus for use with a toilet, in accordance with the first exemplary embodiment of the present disclosure.

FIG. 3 is an illustration of a cross-sectional front view of the apparatus 10 for use with a toilet, in accordance with the first exemplary embodiment of the present disclosure. As can be seen in FIG. 3, the cover 50 is illustrated in an open position, with cover portion 54 in a raised position. In accordance with this disclosure, the raised positioned may be any position of the cover portion 54 where a user can access the interior compartment of the tank 24. There may be a hinging device 58 located between cover portion 54 and cover portion 56, which allows one of the cover portions 54, 56 to move independent of the other cover portion 54, 56. The cover portions 54, 56 may be equal in size or unequal in size to any degree. Further, when the cover portion 54 is moved to the raised position, a cover portion-retaining device 60 may be used to keep the cover portion 54 in the raised position. Thus, when a user desires to remove a toilet utensil 40 from the tank 24, the user may move the cover portion 54 from the closed position to the raised position. The user may then retain the cover portion 54 in the raised position with the cover portion-retaining device 60, if desired, while he or she is using the toilet utensil 40. When the user has finished using the toilet utensil 40, the user may return it to the toilet utensil holding structure 30 within the tank 24 and shut the cover portion 54.

As can be seen, the hinging device 58 and the cover portion-retaining device 60 may include a variety of different structures. For example, the hinging device 58 may be a metal hinge connecting the two cover portions 54, 56. Alternatively, the two cover portions 54, 56 may not be connected at all, such that either can be completely removed from the tank 24. Still further, the apparatus may include a hinge between one or both of the cover portions 54, 56 and a sidewall of the tank 24 itself For the cover portion-retaining device 60, each of the cover portions 54, 56 may include an engagable structure that the cover portion-retaining device 60 connects to. For example, the cover portion-retaining device 60 may include a metal that spans between two engagable structures on the cover portions 54, 56. Other designs are also contemplated which may provide the benefit of the cover portion-retaining device 60, all of which are considered within the scope of the present disclosure.

In accordance with this disclosure, the apparatus 10 may provide a variety of functions and benefits. For example, toilet utensils 40 are often unsightly and unsanitary, and are prone to becoming the object of attention for curious, young children. The toilet utensils 40 may harbor bacteria and harmful substances that the toilet utensils 40 came in contact with when they were used. These bacteria and harmful substances may be easily spread when one touches the toilet utensil 40, which may cause illness or disease. The apparatus 10 allows the toilet utensils 40 to be stored within the tank 24 of the toilet 20, which keeps them away from curious, young children, or other humans or animals that may come into contact with them. Furthermore, the apparatus 10 keeps these often unsightly toilet utensils 40 out of sight and out of the way, making the toilet area more pleasant.

Furthermore, toilet utensils 40 often become visibly dirty from their use, which may create undesired odors and unappealing toilet conditions. For example, after a conventional toilet utensil 40 is used, it often sits by the base of the toilet 20 until it is used again, which results in a dirty and unsanitary toilet utensil 40 for long periods of time. The apparatus 10 not only allows for storing the toilet utensil 40 out of sight, but also stores it partly within the quantity of water 26 inside the tank 24. Thus, the utensil portion 44 of the toilet utensil 40 may reside in the quantity of water 26, which may clean the utensil portion 44 and prevent the spread of bacteria. Even further, each time the toilet 20 is flushed, the quantity of water 26 is drained and replaced with a new quantity of water 26, which acts to further clean the utensil portion 44. The old, dirty water is used to flush the toilet 20 while new, cleaner water surrounds the utensil portion 44. Also, the utensil portion 44 may be subject to water movement, which may remove particulate away from the utensil portion 44. This is all done without using any extra space in a restroom, and without using any extra water than is normally used. As a result, the area surrounding a toilet 20 may be far more pleasant, and the energy and water costs may be decreased.

Figure 4:
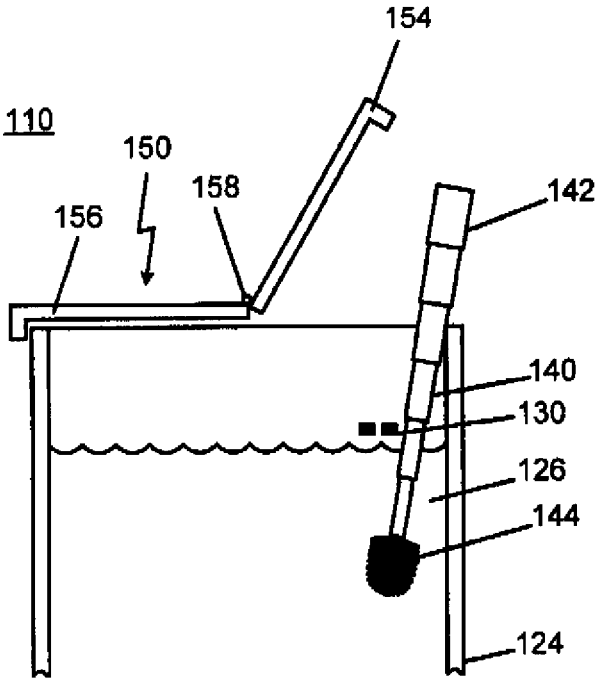
FIGS. 4 and 5 are illustrations of a cross-sectional front view of an apparatus for use with a toilet, in accordance with a second exemplary embodiment of the present disclosure.
Figure 5:
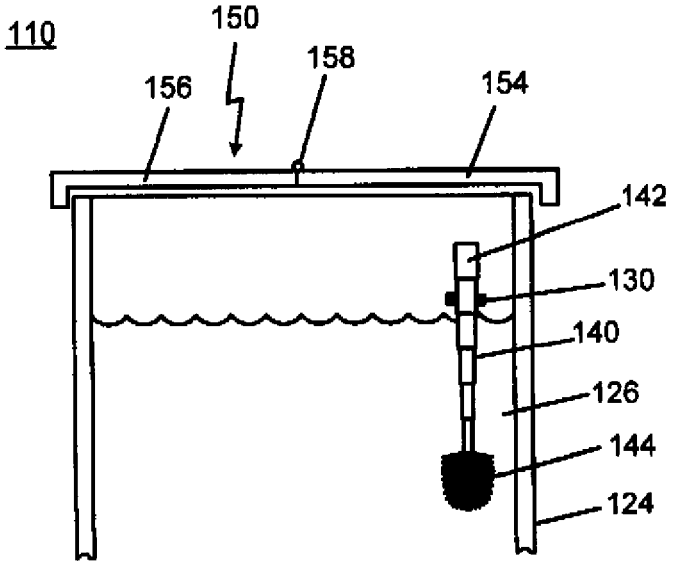

FIGS. 4 and 5 are illustrations of a cross-sectional front view of an apparatus 110 for use with a toilet, in accordance with a second exemplary embodiment of the present disclosure. The apparatus 110 of the second exemplary embodiment is substantially similar to the apparatus 10 of the first exemplary embodiment, and may include any of the components, features, and designs discussed with respect to the first exemplary embodiment. Specifically, FIGS. 4 and 5 depict the apparatus 110 in use with a toilet utensil 140 having a utensil portion 144 and a telescopic handle portion 142. The apparatus 110 functions substantially the same way as described with respect to FIGS. 1-3 and the first exemplary embodiment, but the handle portion 142 of the toilet utensil 140 may be elongated and retracted. This may allow a toilet utensil 140 with a long handle portion 142 to be stored within the confined space of the toilet tank 124.

As is shown in FIG. 4, the toilet utensil 140 may be moved into the tank 124 with the handle portion 142 in the extended position. The extended position may provide more efficient use with the toilet utensil 140, when it is being used. When the toilet utensil 140 is finished being used, the user may open the cover portion 154 of the cover 150, which may be hinged to another cover portion 156 with a hinging device 158, to reveal the interior of the tank 124. The user may be retract the telescoping handle portion 142 by compressing the handle portion 142 towards the linear center (which may be accomplished by pressing the utensil portion 144 against a bottom of the tank 124), and clip the toilet utensil 140 to a toilet utensil holding structure 130 within the tank 124. This action submerges the utensil portion 144 within the quantity of water 126 and retains it in a submerged position. The user may then close the cover portion 154.

Figure 6:
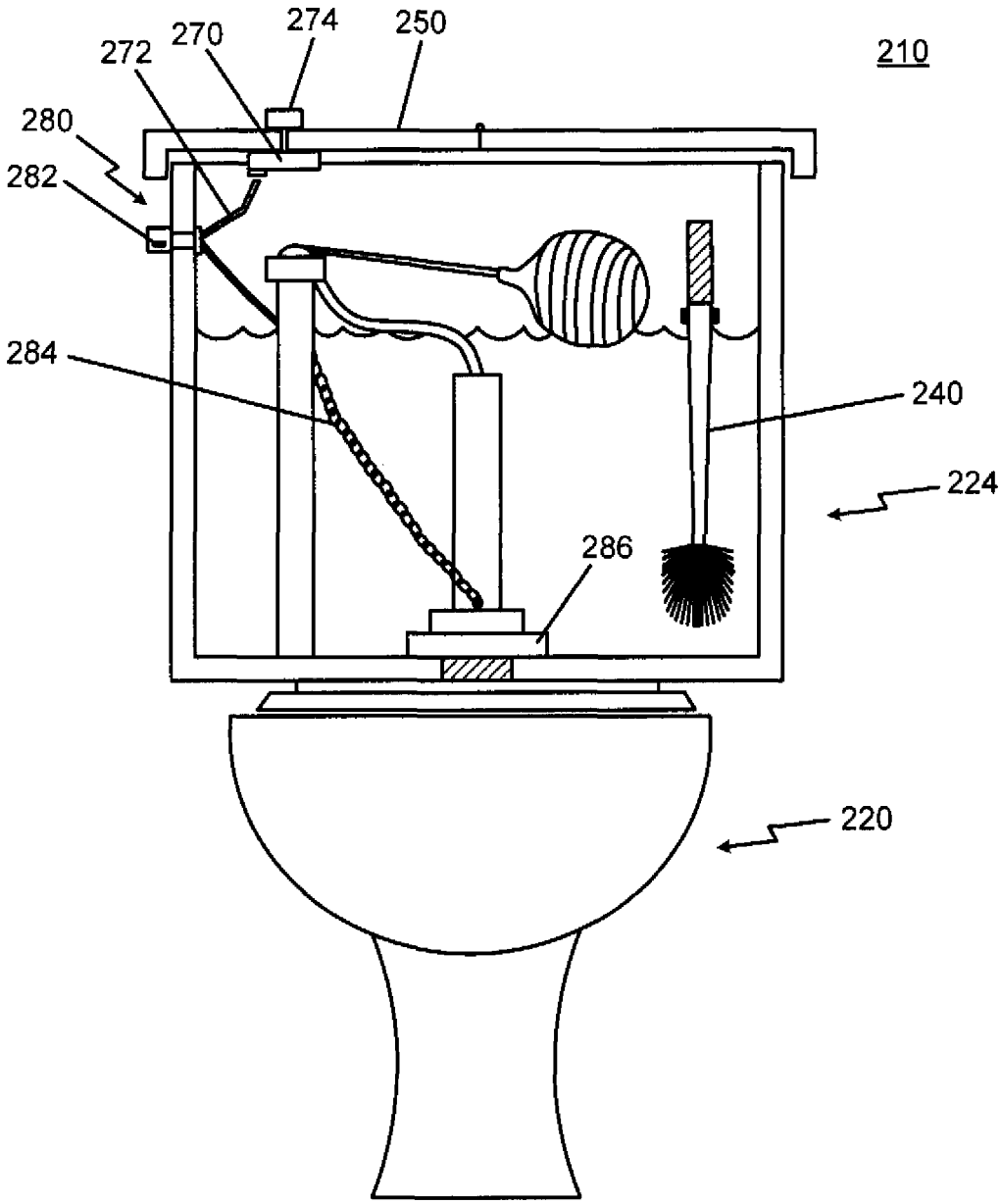
FIGS. 6 and 7 are illustrations of a partial cross-sectional front view of an apparatus for use with a toilet, in accordance with a third exemplary embodiment of the present disclosure.
Figure 7:
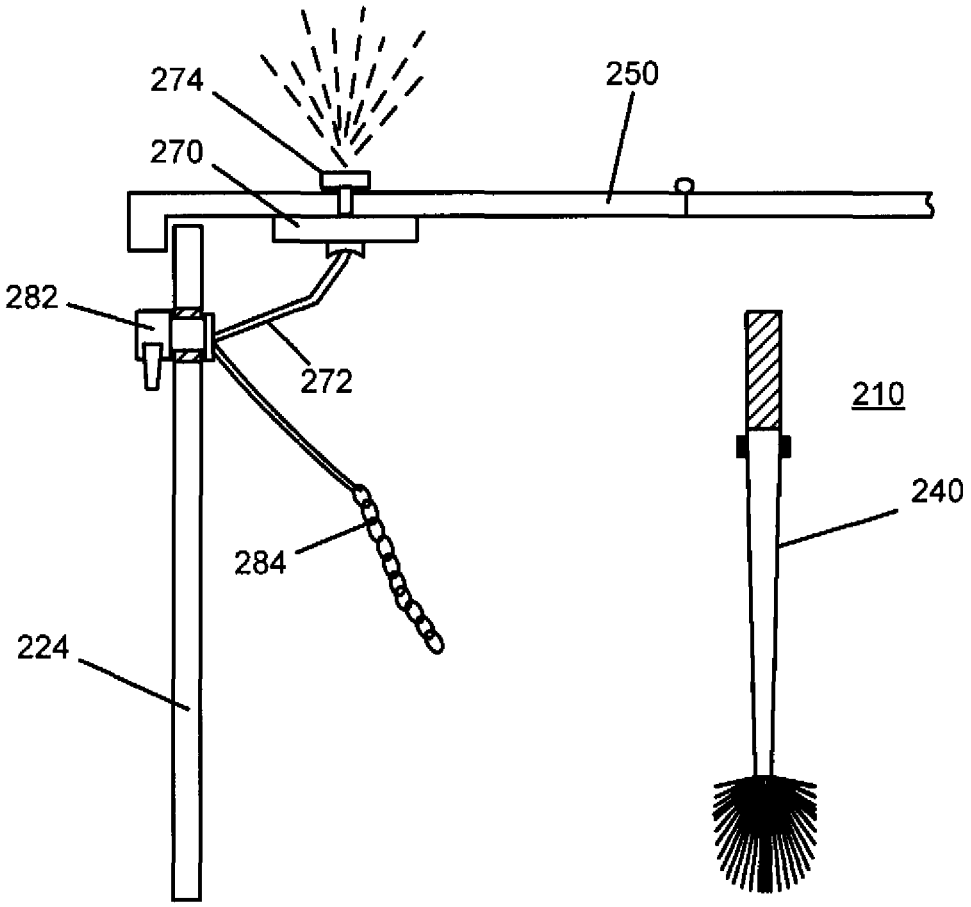

FIGS. 6 and 7 are illustrations of a partial cross-sectional front view of an apparatus 210 for use with a toilet, in accordance with a third exemplary embodiment of the present disclosure. The apparatus 210 of the third exemplary embodiment is substantially similar to the apparatus 10 of the first exemplary embodiment, and the apparatus 110 of the second exemplary embodiment, and may include any of the components, features, and designs discussed with respect to the first and second exemplary embodiments. Apparatus 210 includes an air freshener mechanism 270, which is positioned proximate to the toilet 220 and is in communication with the flushing device 280. When the flushing device 280 is activated, the flushing device 280 engages the air freshener mechanism 270 to release a quantity of air-freshening material into a surrounding atmosphere.

The flushing device 280 may include a flushing handle 282 positioned within the sidewall of the tank 224. The flush handle 282 is connected to a chain 284 within the tank 224, which opens a flush valve flapper 286 when the flush handle 282 is engaged. When the flush handle 282 is engaged, a lever 272 (or similar structure) connected to the flush handle 282 and proximate to the air freshener mechanism 270 may physically engage the air freshener mechanism 270. For example, the air freshener mechanism 270 may be an aerosol or pressurized canister containing a quantity, of air-freshening material. When the flush handle 282 is pressed, the lever 272 may contact a portion of the canister, which then directs some of the air-freshening material to be released. The cover 250 of the tank 224 may include an outlet valve 274, which connects the canister with the atmosphere surrounding the toilet 220. When the lever 272 contacts the canister, the air freshening material may move through the outlet valve 274 and into the atmosphere.

It is noted that the air freshening material may include any substance, such as a misted liquid, an aerosol spray, or other material. Thus, the single action of flushing the toilet 220 may also activate the air freshener mechanism 270. Also, the air freshener mechanism 270 may be controlled or activated with an electronic device, electronic control signal, or any combination thereof As is shown in FIGS. 6-7, the air freshener mechanism 270 is located in an area of the tank 224 not occupied by the toilet utensil 240, thereby leaving space for the toilet utensil 240 to be stored within the tank 224. This arrangement and positioning of the air freshener mechanism 270 may be advantageous, since it may provide convenient use of the toilet utensil 240 without obstructing, contacting, or otherwise disadvantaging the air freshener mechanism 270. However, any position of the air freshener mechanism 270 is considered within the scope of the present disclosure.

The air freshener mechanism 270 may work in conjunction with the toilet utensil holding structure 230, such that both devices provide benefits to anyone who uses or cleans the toilet 220. To ensure that enough space is available within the tank 224, the canister may be affixed to an underside of the tank cover 250. This may prevent the canister from contacting the quantity of water within the tank 224, in addition to saving space inside the tank 224. For example, when a user opens the tank cover 250 to retrieve the toilet utensil 240, the canister may remain affixed to the underside of the tank cover 250, and when the tank cover 250 is moved back into the closed position, the canister may again be located proximate to the lever 272.

As is shown in FIG. 7, the canister may be positioned within a cavity formed within the underside of the tank cover 250. This may further reduce the space occupied by the air freshener mechanism 270 within the tank 224. FIG. 7 also shows the air freshener mechanism 270 in an engaged position. As can be seen, the lever 272 may physically engage the air freshener mechanism 270, or a component thereof, such as the canister. This action may force a quantity of air freshening material through the outlet valve 274 and into the surrounding atmosphere. Other ways of engaging the air freshener mechanism 270 may also be available, such as with electronic or pressure-based devices. For example, a high-pressure or pressure-assist valve may engage the air freshener mechanism 270 by transmitting a pressurized substance (or a structure moved with a pressurized substance) to contact the air freshener mechanism 270. Accordingly, all variations are considered within the scope of the present disclosure.

Figure 8:
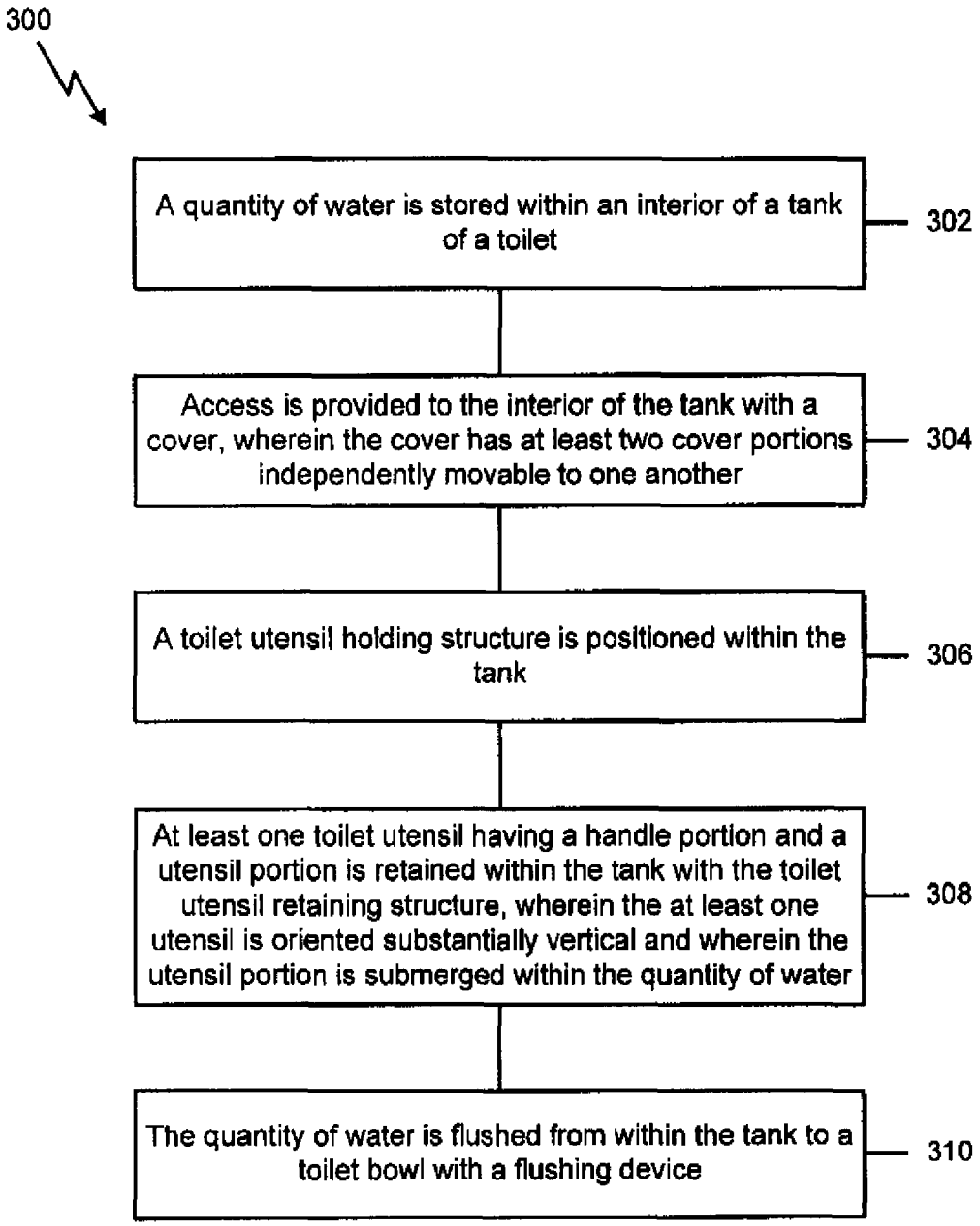
FIG. 8 is a flowchart illustrating a method of storing and cleaning toilet utensils shown in FIG. 1, in accordance with the first exemplary embodiment of the present disclosure.

FIG. 8 is a flowchart 300 illustrating a method of storing and cleaning toilet utensils shown in FIG. 1, in accordance with the first exemplary embodiment of the present disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 302, a quantity of water 26 is stored within an interior of a tank 24 of a toilet 20. Access is provided to the interior of the tank 20 with a cover 50, wherein the cover 50 has at least two cover portions 54, 56 independently movable to one another (Block 304). A toilet utensil holding structure 30 is positioned within the tank 24 (Block 306). At least one toilet utensil 40 having a handle portion 42 and a utensil portion 44 is retained within the tank 24 with the toilet utensil retaining structure 30, wherein the at least one utensil 40 is oriented substantially vertical and wherein the utensil portion 44 is submerged within the quantity of water 26 (Block 308). The quantity of water 26 is flushed from within the tank 24 to a toilet bowl 22 with a flushing device 28 (Block 310).

Any number of additional steps may also be included within the method, including any of the methods, processes, and/or functions described with respect to FIGS. 1-7. For example, the method may include the step of refilling the tank with a second quantity of water after flushing, wherein the at least one utensil is oriented substantially vertical and wherein the utensil portion is submerged within the second quantity of water. Furthermore, with respect to the third exemplary embodiment discussed in FIGS. 6-7, the method may also include the steps of positioning an air freshener mechanism proximate to the toilet and in communication with the flushing device and releasing a quantity of air-freshening material into a surrounding atmosphere by engaging the flushing device. As discussed, the air freshener mechanism may include a canister housing the quantity of air-freshening material. The canister may be affixed to an underside of the tank cover in a position where the canister does not contact the quantity of water. With respect to the second exemplary embodiment discussed with FIGS. 4-5, retaining the least one toilet utensil having a telescopic handle portion and a utensil portion within the tank with the toilet utensil retaining structure may include retracting or extending the telescopic handle portion.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure and the present disclosure and protected by the following claims.

What is claimed is:

1. A toilet utensil holding apparatus comprising:

a toilet having a toilet bowl, a tank having an interior space holding a quantity of water, and a flushing device controlling a flow of the quantity of water from the interior space of the tank to the toilet bowl;

a toilet utensil holding structure located within the interior space of the tank, the toilet utensil holding structure comprising a substantially linear, rigid bar traversing between a first sidewall of the tank and a second sidewall of the tank and positioned in contact with an interior surface of each of the first and second sidewall, wherein the first sidewall is positioned opposite the second sidewall, and wherein each of the first and second sidewalls define an exterior wall of the tank;

at least one utensil-retaining member affixed to the substantially linear, rigid bar, the at least one utensil-retaining member further comprising a friction clip sized to receive and retain a portion of a handle portion of at least one toilet utensil, wherein the at least one toilet utensil is stationarily held by the at least one utensil-retaining member within the interior space of the tank; and a tank cover positioned over an upper opening in the tank, the tank cover having at least two cover portions independently movable to one another, wherein at least one of the two cover portions controls access to the at least one toilet utensil.

2. The toilet utensil holding apparatus of claim 1, wherein the at least one toilet utensil further comprises a handle portion and a utensil portion, wherein the toilet utensil holding structure is positioned to hold the toilet utensil in a substantially vertical position, wherein the utensil portion is submerged within the quantity of water and the handle portion is not submerged in the quantity of water.

3. The toilet utensil holding apparatus of claim 2, wherein the handle portion is telescopic.

4. The toilet utensil holding apparatus of claim 1, further comprising a cover portion retaining device positioned to retain at least one of the two cover portions of the tank cover in an open position.

5. The toilet utensil holding apparatus of claim 1, wherein the toilet utensil holding structure is affixed to the at least one sidewall of the tank with at least one fastener.

6. The toilet utensil holding apparatus of claim 1, wherein the toilet utensil holding structure is affixed between the inside surfaces of at least two sidewalls, wherein the inside surfaces of the at least two sidewalls are opposing one another.

7. The toilet utensil holding apparatus of claim 1, wherein the at least one toilet utensil further comprises at least one of a toilet plunger and a toilet cleaning brush.

8. The toilet utensil holding apparatus of claim 1, further comprising an air freshener mechanism positioned proximate to the toilet and in communication with the flushing device, wherein activation of the flushing device activates the air freshener mechanism to release a quantity of air-freshening material into a surrounding atmosphere.

9. The toilet utensil holding apparatus of claim 8, wherein the air freshener mechanism further comprises a lever positioned between a flushing handle of the toilet and a canister holding the quantity of air-freshening material, wherein engagement of the flushing handle moves the lever to engage the canister and release the quantity of air-freshening material, wherein the released quantity of air-freshening material is released to the surrounding atmosphere through an outlet positioned within at least one of the cover portions of the cover between an interior of the tank and the surrounding atmosphere, wherein the outlet is positioned through an entire thickness of the at least one of the cover portions.

10. The toilet utensil holding apparatus of claim 9, wherein the canister is affixed to an underside of the tank cover in a position where the canister does not contact the quantity of water.

11. The toilet utensil holding apparatus of claim 10, wherein the canister is positioned within a cavity formed within the underside of the tank cover.

12. The toilet utensil holding apparatus of claim 1, further comprising an air freshener mechanism positioned proximate to the toilet and in communication with the flushing device, wherein activation of the flushing device activates the air freshener mechanism to release a quantity of air-freshening material into a surrounding atmosphere.

13. The toilet utensil holding apparatus of claim 2, wherein a terminating end of the handle portion is positioned between a top surface of the quantity of water and an interior surface of the tank cover.

14. A toilet utensil holding apparatus comprising:

a toilet having a toilet bowl, a tank having an interior space holding a quantity of water, and a flushing device controlling a flow of the quantity of water from the interior space of the tank to the toilet bowl;

a toilet utensil holding structure located within the interior space of the tank, the toilet utensil holding structure comprising a substantially linear, rigid bar traversing between a first sidewall of the tank and a second sidewall of the tank and positioned in contact with an interior surface of each of the first and second sidewall, wherein the first sidewall is positioned opposite the second sidewall, and wherein each of the first and second sidewalls define an exterior wall of the tank;

at least one utensil-retaining member affixed to the substantially linear, rigid bar, the at least one utensil-retaining member further comprising a friction clip sized to receive and retain a portion of a handle portion of at least one toilet utensil, wherein the at least one toilet utensil is stationarily held by the at least one utensil-retaining member within the interior space of the tank; and a tank cover positioned over an upper opening in the tank, the tank cover having a first cover portion and a second cover portion connected with at least one hinge, wherein the first cover portion is independently movable relative to the second cover portion, wherein in a closed position, each of the first and second cover portions prevents access to the at least one toilet utensil within the interior space of the tank, and in an open position, each of the first and second cover portions provides access to the at least one toilet utensil within the interior space of the tank.

15. The toilet utensil holding of claim 1, wherein the substantially linear, rigid bar traversing between the first sidewall of the tank and the second sidewall of the tank and positioned in contact with the interior surface of each of the first and second sidewall is biased in opposing directions against the interior surface of each of the first and second sidewall.

* * * * *